US008739880B2

(12) United States Patent
Dykstra et al.

(10) Patent No.: US 8,739,880 B2
(45) Date of Patent: Jun. 3, 2014

(54) FLUID DISCRIMINATION FOR USE WITH A SUBTERRANEAN WELL

(71) Applicant: Halliburton Energy Services, Inc., Houston, TX (US)

(72) Inventors: Jason D. Dykstra, Carrollton, TX (US); Michael L. Fripp, Carrollton, TX (US)

(73) Assignee: Halliburton Energy Services, P.C., Houston, TX (US)

( * ) Notice: Subject to any disclaimer, the term of this patent is extended or adjusted under 35 U.S.C. 154(b) by 0 days.

(21) Appl. No.: 13/659,375

(22) Filed: Oct. 24, 2012

(65) Prior Publication Data

US 2013/0112424 A1 May 9, 2013

(51) Int. Cl.
*E21B 34/00* (2006.01)

(52) U.S. Cl.
USPC ..... 166/320; 137/810; 137/4; 137/875

(58) Field of Classification Search
USPC ..... 166/373, 316, 319, 320; 137/808, 810, 137/835–837, 839, 2, 4, 89, 92, 875, 876
See application file for complete search history.

(56) References Cited

U.S. PATENT DOCUMENTS

| | | | | |
|---|---|---|---|---|
| 2,140,735 | A * | 12/1938 | Clarke et al. | 184/104.1 |
| 2,324,819 | A | 6/1941 | Butzbach | |
| 3,078,862 | A | 2/1963 | Maly | |
| 3,091,393 | A | 5/1963 | Sparrow | |
| 3,282,279 | A | 11/1966 | Manion | |
| 3,461,897 | A | 8/1969 | Kwok | |
| 3,470,894 | A | 10/1969 | Rimmer | |
| 3,474,670 | A | 10/1969 | Rupert | |
| 3,489,009 | A | 1/1970 | Rimmer | |
| 3,515,160 | A | 6/1970 | Cohen | |
| 3,529,614 | A | 9/1970 | Nelson | |
| 3,537,466 | A | 11/1970 | Chapin | |

(Continued)

FOREIGN PATENT DOCUMENTS

| | | |
|---|---|---|
| EP | 0834342 A2 | 4/1998 |
| EP | 1857633 A2 | 11/2007 |

(Continued)

OTHER PUBLICATIONS

Joseph M. Kirchner, "Fluid Amplifiers", 1996, 6 pages, McGraw-Hill, New York.

(Continued)

*Primary Examiner* — Shane Bomar
*Assistant Examiner* — Kipp Wallace
(74) *Attorney, Agent, or Firm* — Smith IP Services, P.C

(57) ABSTRACT

A fluid discrimination system can include a fluid discriminator which selects through which of multiple outlet flow paths a fluid composition flows, the selection being based on a direction of flow of the fluid composition through the discriminator, and the direction being dependent on a fluid type in the fluid composition. Another fluid discriminator can include a structure which displaces in response to a fluid composition flow, whereby an outlet flow path of the fluid composition changes in response to a change in a ratio of fluids in the fluid composition. A method of discriminating between fluids can include providing a fluid discriminator which selects through which of multiple outlet flow paths a fluid composition flows in the well, the selection being based on a direction of flow of the fluid composition through the discriminator, and the direction being dependent on a ratio of the fluids in the fluid composition.

18 Claims, 12 Drawing Sheets

(56) References Cited

U.S. PATENT DOCUMENTS

| | | | | |
|---|---|---|---|---|
| 3,566,900 | A * | 3/1971 | Black | 137/83 |
| 3,598,137 | A | 8/1971 | Glaze | |
| 3,620,238 | A | 11/1971 | Kawabata | |
| 3,670,753 | A | 6/1972 | Healey | |
| 3,704,832 | A | 12/1972 | Fix et al. | |
| 3,712,321 | A | 1/1973 | Bauer | |
| 3,717,164 | A | 2/1973 | Griffin | |
| 3,754,576 | A * | 8/1973 | Zetterstrom et al. | 137/829 |
| 3,776,460 | A | 12/1973 | Fichter | |
| 3,885,627 | A | 5/1975 | Berry et al. | |
| 3,942,557 | A | 3/1976 | Tsuchiya | |
| 4,029,127 | A | 6/1977 | Thompson | |
| 4,082,169 | A | 4/1978 | Bowles | |
| 4,127,173 | A | 11/1978 | Watkins et al. | |
| 4,167,073 | A | 9/1979 | Tang | |
| 4,167,873 | A * | 9/1979 | Bahrton | 73/861.19 |
| 4,187,909 | A | 2/1980 | Erstoesser | |
| 4,276,943 | A | 7/1981 | Holmes | |
| 4,286,627 | A | 9/1981 | Graf | |
| 4,291,395 | A | 9/1981 | Holmes | |
| 4,307,653 | A | 12/1981 | Goes et al. | |
| 4,385,875 | A | 5/1983 | Kanazawa | |
| 4,418,721 | A | 12/1983 | Holmes | |
| 4,557,295 | A | 12/1985 | Holmes | |
| 4,919,204 | A | 4/1990 | Baker et al. | |
| 5,165,450 | A * | 11/1992 | Marrelli | 137/875 |
| 5,184,678 | A | 2/1993 | Pechkov et al. | |
| 5,455,804 | A | 10/1995 | Holmes et al. | |
| 5,484,016 | A | 1/1996 | Surjaatmadja et al. | |
| 5,505,262 | A | 4/1996 | Cobb | |
| 5,533,571 | A | 7/1996 | Surjaatmadja et al. | |
| 5,893,383 | A | 4/1999 | Facteau | |
| 6,015,011 | A | 1/2000 | Hunter | |
| 6,078,471 | A | 6/2000 | Fiske | |
| 6,109,372 | A | 8/2000 | Dorel et al. | |
| 6,241,019 | B1 | 6/2001 | Davidson et al. | |
| 6,336,502 | B1 | 1/2002 | Surjaatmadja et al. | |
| 6,345,963 | B1 | 2/2002 | Thomin et al. | |
| 6,367,547 | B1 | 4/2002 | Towers et al. | |
| 6,371,210 | B1 | 4/2002 | Bode et al. | |
| 6,405,797 | B2 | 6/2002 | Davidson et al. | |
| 6,497,252 | B1 | 12/2002 | Kohler et al. | |
| 6,619,394 | B2 | 9/2003 | Soliman et al. | |
| 6,622,794 | B2 | 9/2003 | Zisk, Jr. | |
| 6,627,081 | B1 | 9/2003 | Hilditch et al. | |
| 6,644,412 | B2 | 11/2003 | Bode et al. | |
| 6,691,781 | B2 | 2/2004 | Grant et al. | |
| 6,719,048 | B1 | 4/2004 | Ramos et al. | |
| 6,851,473 | B2 | 2/2005 | Davidson | |
| 6,913,079 | B2 | 7/2005 | Tubel | |
| 6,976,507 | B1 | 12/2005 | Webb et al. | |
| 7,025,134 | B2 | 4/2006 | Byrd et al. | |
| 7,114,560 | B2 | 10/2006 | Nguyen et al. | |
| 7,185,706 | B2 | 3/2007 | Freyer | |
| 7,213,650 | B2 | 5/2007 | Lehman et al. | |
| 7,213,681 | B2 | 5/2007 | Birchak et al. | |
| 7,216,738 | B2 | 5/2007 | Birchak et al. | |
| 7,290,606 | B2 | 11/2007 | Coronado et al. | |
| 7,318,471 | B2 | 1/2008 | Rodney et al. | |
| 7,404,416 | B2 | 7/2008 | Schultz et al. | |
| 7,405,998 | B2 | 7/2008 | Webb et al. | |
| 7,409,999 | B2 | 8/2008 | Henriksen et al. | |
| 7,413,010 | B2 | 8/2008 | Blauch et al. | |
| 7,537,056 | B2 | 5/2009 | MacDougall | |
| 7,578,343 | B2 | 8/2009 | Augustine | |
| 7,828,067 | B2 | 11/2010 | Scott et al. | |
| 8,127,856 | B1 | 3/2012 | Nish et al. | |
| 8,235,128 | B2 | 8/2012 | Dykstra et al. | |
| 8,302,696 | B2 | 11/2012 | Williams et al. | |
| 8,327,885 | B2 | 12/2012 | Dykstra et al. | |
| 2007/0045038 | A1 | 3/2007 | Han et al. | |
| 2007/0256828 | A1 | 11/2007 | Birchak et al. | |
| 2008/0035350 | A1 | 2/2008 | Henriksen et al. | |
| 2008/0041580 | A1 | 2/2008 | Freyer et al. | |
| 2008/0041581 | A1 | 2/2008 | Richards | |
| 2008/0041582 | A1 | 2/2008 | Saetre et al. | |
| 2008/0041588 | A1 | 2/2008 | Richards et al. | |
| 2008/0149323 | A1 | 6/2008 | O'Malley et al. | |
| 2008/0236839 | A1 * | 10/2008 | Oddie | 166/373 |
| 2008/0261295 | A1 * | 10/2008 | Butler et al. | 435/286.5 |
| 2008/0283238 | A1 | 11/2008 | Richards et al. | |
| 2009/0008088 | A1 | 1/2009 | Schultz et al. | |
| 2009/0008090 | A1 | 1/2009 | Schultz et al. | |
| 2009/0009297 | A1 | 1/2009 | Shinohara et al. | |
| 2009/0009333 | A1 | 1/2009 | Bhogal et al. | |
| 2009/0009336 | A1 | 1/2009 | Ishikawa | |
| 2009/0009412 | A1 | 1/2009 | Warther | |
| 2009/0009437 | A1 | 1/2009 | Hwang et al. | |
| 2009/0009445 | A1 | 1/2009 | Lee | |
| 2009/0009447 | A1 | 1/2009 | Naka et al. | |
| 2009/0065197 | A1 | 3/2009 | Eslinger | |
| 2009/0078427 | A1 | 3/2009 | Patel | |
| 2009/0078428 | A1 | 3/2009 | Ali | |
| 2009/0101354 | A1 | 4/2009 | Holmes et al. | |
| 2009/0120647 | A1 | 5/2009 | Turick et al. | |
| 2009/0133869 | A1 | 5/2009 | Clem | |
| 2009/0151925 | A1 | 6/2009 | Richards et al. | |
| 2009/0159282 | A1 | 6/2009 | Webb et al. | |
| 2009/0250224 | A1 | 10/2009 | Wright et al. | |
| 2009/0277639 | A1 | 11/2009 | Schultz et al. | |
| 2009/0277650 | A1 | 11/2009 | Casciaro et al. | |
| 2011/0042091 | A1 | 2/2011 | Dykstra et al. | |
| 2011/0042092 | A1 * | 2/2011 | Fripp et al. | 166/319 |
| 2011/0186300 | A1 | 8/2011 | Dykstra et al. | |
| 2011/0198097 | A1 | 8/2011 | Moen | |
| 2011/0214876 | A1 | 9/2011 | Dykstra et al. | |
| 2011/0297384 | A1 | 12/2011 | Fripp et al. | |
| 2011/0297385 | A1 | 12/2011 | Dykstra et al. | |
| 2012/0048563 | A1 | 3/2012 | Holderman | |
| 2012/0060624 | A1 | 3/2012 | Dykstra | |
| 2012/0061088 | A1 | 3/2012 | Dykstra et al. | |
| 2012/0255739 | A1 | 10/2012 | Fripp | |
| 2013/0112423 | A1 | 5/2013 | Dykstra et al. | |

FOREIGN PATENT DOCUMENTS

| | | | |
|---|---|---|---|
| WO | 0214647 | A1 | 2/2002 |
| WO | 03062597 | A1 | 7/2003 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |

OTHER PUBLICATIONS

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Specification and Drawings for U.S. Appl. No. 12/792,095, filed Jun. 2, 2010, 29 pages.

Specification and Drawings for U.S. Appl. No. 10/650,186, filed Aug. 28, 2003, 16 pages.

Apparatus and Method of Inducing Fluidic Oscillation in a Rotating Cleaning Nozzle, ip.com, dated Apr. 24, 2007, 3 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

(56) References Cited

OTHER PUBLICATIONS

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.
International Search Report and Written Opinion issued Mar. 25, 2011 for International Patent Application Serial No. PCT/US2010/044409, 9 pages.
International Search Report and Written Opinion issued Mar. 31, 2011 for International Patent Application Serial No. PCT/US2010/044421, 9 pages.
Office Action issued Jun. 27, 2011, for U.S. Appl. No. 12/791,993, 17 pages.
Search Report issued Aug. 3, 2012 for International Application serial No. PCT/US11/59534, 5 pages.
Written Opinion issued Aug. 3, 2012 for International Application serial No. PCT/US11/59534, 9 pages.
Specification and Drawings for U.S. Appl. No. 12/542,695, filed Aug. 18, 2009, 32 pages.
International Search Report with Written Opinion issued Aug. 3, 2012 for PCT Patent Application No. PCT/US11/059530, 15 pages.
International Search Report with Written Opinion issued Aug. 3, 2012 for PCT Patent Application No. PCT/US11/059534, 14 pages.
Office Action issued Jul. 25, 2012 for U.S. Appl. No. 12/881,296, 61 pages.
Search Report and Written Opinion issued Oct. 19, 2012 for International Application No. PCT/US12/30641, 9 pages.
Advisory Action issued Aug. 30, 2012 for U.S. Appl. No. 13/111,169, 15 pages.
Office Action issued Sep. 10, 2012 for U.S. Appl. No. 12/792,095, 59 pages.
Office Action issued Mar. 4, 2013 for U.S. Appl. No. 13/659,375, 24 pages.
Office Action issued Feb. 21, 2013 for U.S. Appl. No. 12/792,095, 26 pages.
Office Action issued Mar. 4, 2013 for U.S. Appl. No. 13/678,497, 26 pages.
Advisory Action issued Mar. 14, 2013 for U.S. Appl. No. 13/495,078, 14 pages.
Patent Application and Drawings for U.S. Appl. No. 13/351,035, filed Jan. 16, 2012, 62 pages.
Patent Application and Drawings for U.S. Appl. No. 13/359,617, filed Jan. 27, 2012, 42 pages.
Patent Application and Drawings for U.S. Appl. No. 12/958,625, filed Dec. 2, 2010, 37 pages.
Patent Application and Drawings for U.S. Appl. No. 12/974,212, filed Dec. 21, 2010, 41 pages.
Office Action issued Mar. 7, 2012 for U.S. Appl. No. 12/792,117, 40 pages.
Office Action issued Mar. 8, 2012 for U.S. Appl. No. 12/792,146, 26 pages.
Office Action issued Jun. 19, 2012 for U.S. Appl. No. 13/111,169, 17 pages.
Office Action issued Apr. 23, 2013 for U.S. Appl. No. 13/659,323, 65 pages.
Office Action issued Apr. 24, 2013 for U.S. Appl. No. 13/633,693, 33 pages.
Office Action issued Apr. 26, 2013 for U.S. Appl. No. 13/678,489, 51 pages.
Office Action issued May 8, 2013 for U.S. Appl. No. 12/792,095, 14 pages.
Office Action issued Dec. 28, 2012 for U.S. Appl. No. 12/881,296, 29 pages.
Office Action issued Jan. 16, 2013 for U.S. Appl. 13/495,078, 24 pages.
Office Action issued Jan. 17, 2013 for U.S. Appl. No. 12/879,846, 26 pages.
Office Action issued Jan. 22, 2013 for U.S. Appl. No. 12/633,693, 30 pages.
Office Action issued May 29, 2013 for U.S. Appl. No. 12/881,296, 26 pages.
Office Action issued Nov. 2, 2011 for U.S. Appl. No. 12/792,146, 34 pages.
Office Action issued Nov. 3, 2011 for U.S. Appl. No. 13/111,169, 16 pages.
Office Action issued Nov. 2, 2011 for U.S. Appl. No. 12/792,117, 35 pages.
Office Action issued Oct. 27, 2011 for U.S. Appl. No. 12/791,993, 15 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31, 2002, 8 pages.
Office Action issued Dec. 24, 2013 for U.S. Appl. No. 12/881,296, 30 pages.
Advisory Action issued Dec. 27, 2013 for U.S. Appl. No. 12/792,095, 8 pages.
Office Action issued Oct. 11, 2013 for U.S. Appl. No. 12/792,095, 18 pages.
Office Action issued Aug. 23, 2013 for U.S. Appl. No. 13/084,025, 93 pages.
Office Action issued Nov. 5, 2013 for U.S. Appl. No. 13/084,025, 23 pages.

* cited by examiner

FLUID DISCRIMINATION FOR USE WITH A SUBTERRANEAN WELL

CROSS-REFERENCE TO RELATED APPLICATION

This application claims the benefit under 35 USC §119 of the filing date of International Application Serial No. PCT/US11/59534, filed 7 Nov. 2011. The entire disclosure of this prior application is incorporated herein by this reference.

BACKGROUND

This disclosure relates generally to equipment utilized and operations performed in conjunction with a subterranean well and, in an example described herein, more particularly provides for fluid discrimination with well fluids.

Among the many reasons for discriminating between fluids are included: a) fluid separation, b) control of produced fluids, c) control over the origin of produced fluids, d) prevention of formation damage, e) conformance, f) control of injected fluids, g) control over which zones receive injected fluids, h) prevention of gas or water coning, i) stimulation, etc. Therefore, it will be appreciated that improvements in the art are continually needed.

SUMMARY

In this disclosure, systems and methods are provided which bring improvements to the art of discriminating between fluids in conjunction with well operations. One example is described below in which a change in direction of flow of fluids through a fluid discrimination system changes a resistance to the flow. Another example is described below in which a fluid composition is routed to different outlet flow paths by a fluid discriminator, depending on properties, characteristics, etc. of the fluid composition.

In one described example, a fluid discrimination system for use with a subterranean well can include a fluid discriminator which selects through which of multiple outlet flow paths a fluid composition flows. The selection can be based on at least one direction of flow of the fluid composition through the fluid discriminator. The direction may be dependent on at least one fluid type in the fluid composition.

In another example, a fluid discriminator can include a structure which displaces in response to a flow of a fluid composition. An outlet flow path of a majority of the fluid composition may change in response to a change in a ratio of fluids in the fluid composition.

In a further example, a method of discriminating between fluids flowed in a subterranean well can include providing a fluid discriminator which selects through which of multiple outlet flow paths a fluid composition flows in the well. The fluid discriminator can perform the selection based on a direction of flow of the fluid composition through the fluid discriminator, which direction can be dependent on a ratio of the fluids in the fluid composition.

These and other features, advantages and benefits will become apparent to one of ordinary skill in the art upon careful consideration of the detailed description of representative embodiments of the disclosure below and the accompanying drawings, in which similar elements are indicated in the various figures using the same reference numbers.

DETAILED DESCRIPTION

Figure 1:
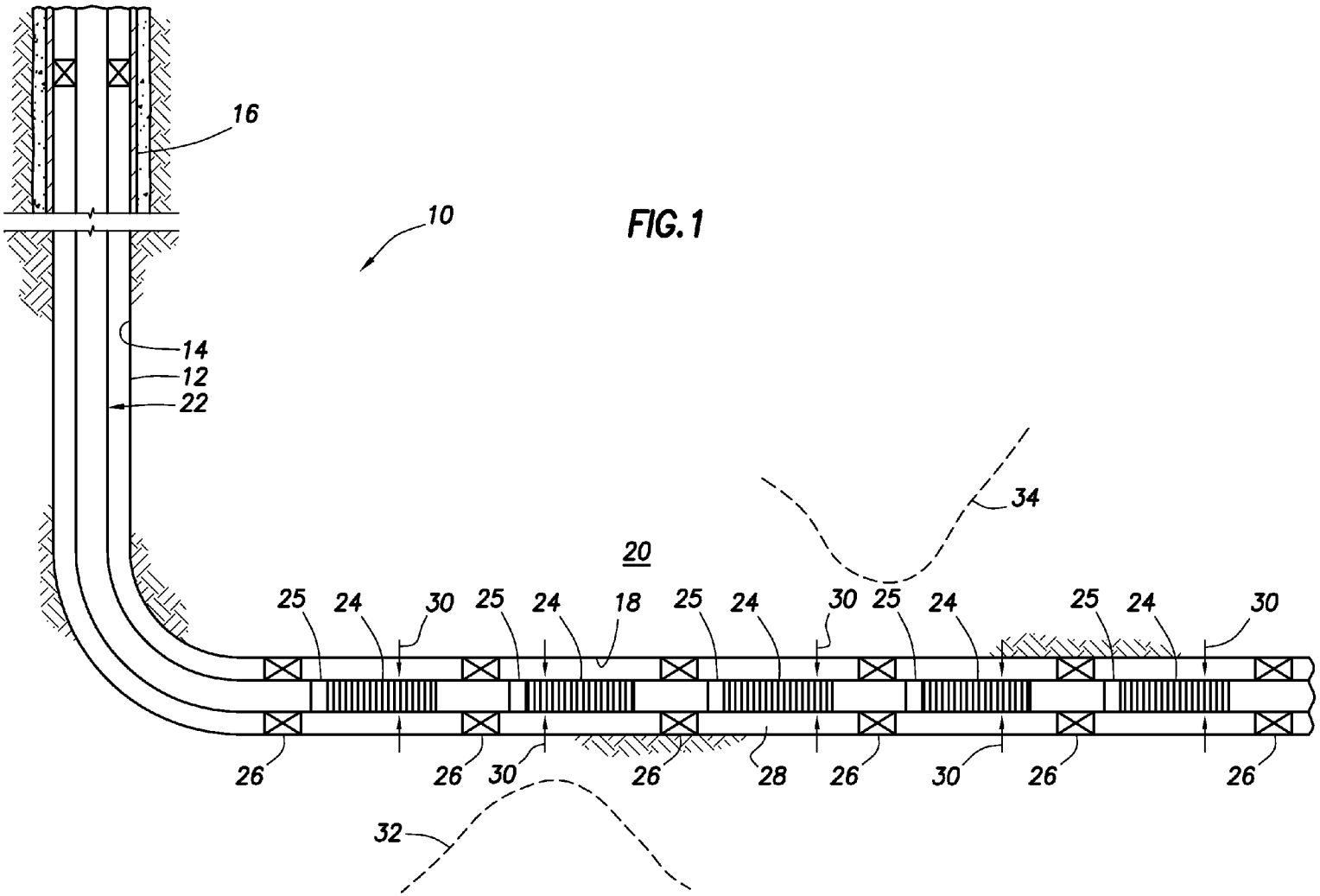
FIG. 1 is a representative partially cross-sectional view of a system and associated method which can embody principles of this disclosure.

Representatively illustrated in FIG. 1 is a system 10 for use with a well, which system can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, fluid discrimination systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a fluid discrimination system 25 are interconnected in the tubular string 22. The well screen 24 filters the fluids 30 flowing into the tubular string 22 from the annulus 28. The fluid discrimination system 25 discriminates between the fluids 30 that are flowed into the tubular string 22, based on certain characteristics of the fluids.

At this point, it should be noted that the system 10 is illustrated in the drawings and is described herein as merely one example of a wide variety of systems in which the principles of this disclosure can be utilized. It should be clearly understood that the principles of this disclosure are not limited at all to any of the details of the system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and fluid discrimination system 25 to be positioned between each adjacent pair of the packers 26. It is not necessary for a single fluid discrimination system 25 to be used in conjunction with a single well screen 24. Any number, arrangement and/or combination of these components may be used.

It is not necessary for any fluid discrimination system 25 to be used with a well screen 24. For example, in injection operations, the injected fluid could be flowed through a fluid discrimination system 25, without also flowing through a well screen 24.

It is not necessary for the well screens 24, fluid discrimination systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, transmitting signals, etc.

In certain examples described below, resistance to flow through the systems 25 can be selectively varied, on demand and/or in response to a particular condition. For example, flow through the systems 25 could be relatively restricted while the tubular string 22 is installed, and during a gravel packing operation, but flow through the systems could be relatively unrestricted when producing the fluid 30 from the formation 20. As another example, flow through the systems 25 could be relatively restricted at elevated temperature indicative of steam breakthrough in a steam flooding operation, but flow through the systems could be relatively unrestricted at reduced temperatures.

An example of the fluid discrimination systems 25 described more fully below can also increase resistance to flow if a fluid velocity or density increases (e.g., to thereby balance flow among zones, prevent water or gas coning, etc.), or increase resistance to flow if a fluid viscosity decreases (e.g., to thereby restrict flow of an undesired fluid, such as water or gas, in an oil producing well). Conversely, these fluid discrimination systems 25 can decrease resistance to flow if fluid velocity or density decreases, or if fluid viscosity increases.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to inject steam instead of water, then steam is a desired fluid and water is an undesired fluid. If it is desired to produce hydrocarbon gas and not water, then hydrocarbon gas is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

In other examples, a fluid discriminator of the system 25 can be used to separate fluids in the fluid composition 36 (for example, to flow different fluid types to respective different processing facilities, to produce only certain fluid type(s), to inject only certain fluid type(s), etc.). Thus, it should be understood that the fluid discriminator may be used for any purpose, and is not necessarily used for variably resisting flow, in keeping with the scope of this disclosure.

Figure 2:
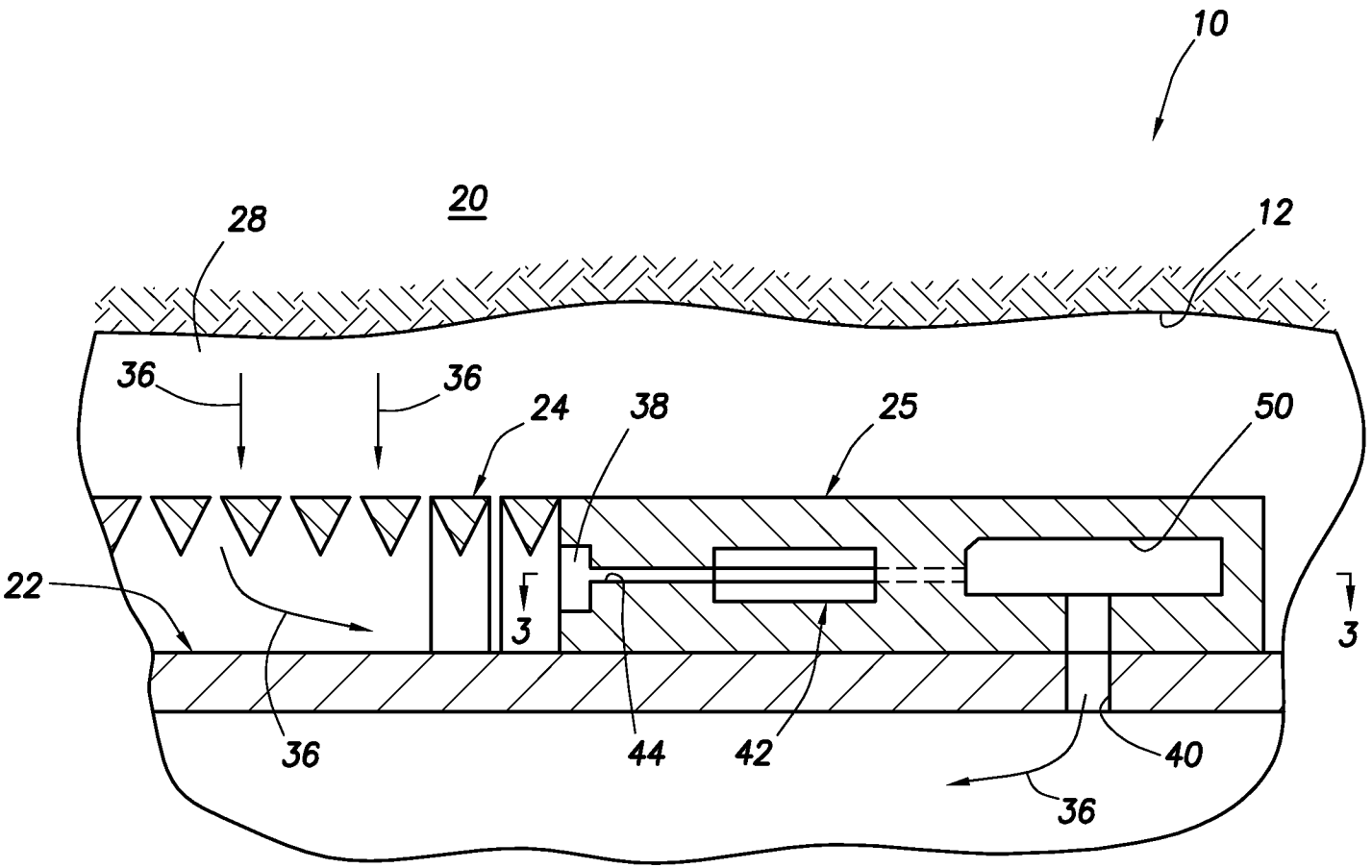
FIG. 2 is a representative cross-sectional view of a fluid discrimination system which can embody the principles of this disclosure.

Referring additionally now to FIG. 2, an enlarged scale cross-sectional view of one of the fluid discrimination systems 25, and a portion of one of the well screens 24, is representatively illustrated. In this example, a fluid composition 36 (which can include one or more fluid types, such as oil and water, liquid water and steam, oil and gas, gas and water, oil, water and gas, etc.) flows into the well screen 24, is thereby filtered, and then flows into an inlet 38 of the fluid discrimination system 25.

A fluid composition can include one or more undesired or desired fluids. Both steam and liquid water can be combined in a fluid composition. As another example, oil, water and/or gas can be combined in a fluid composition.

Flow of the fluid composition 36 through the fluid discrimination system 25 is resisted based on one or more characteristics (such as flow direction, viscosity, velocity, density, etc.) of the fluid composition. The fluid composition 36 is then discharged from the fluid discrimination system 25 to an interior of the tubular string 22 via an outlet 40.

In other examples, the well screen 24 may not be used in conjunction with the fluid discrimination system 25 (e.g., in injection operations), the fluid composition 36 could flow in an opposite direction through the various elements of the well system 10 (e.g., in injection operations), a single fluid discrimination system could be used in conjunction with multiple well screens, multiple fluid discrimination systems could be used with one or more well screens, the fluid composition could be received from or discharged into regions of a well other than an annulus or a tubular string, the fluid composition could flow through the fluid discrimination system prior to flowing through the well screen, any other components could be interconnected upstream or downstream of the well screen and/or fluid discrimination system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The fluid discrimination system 25 is depicted in simplified form in FIG. 2, but in a preferred example, the system can include various passages and devices for performing various functions, some examples of which are described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
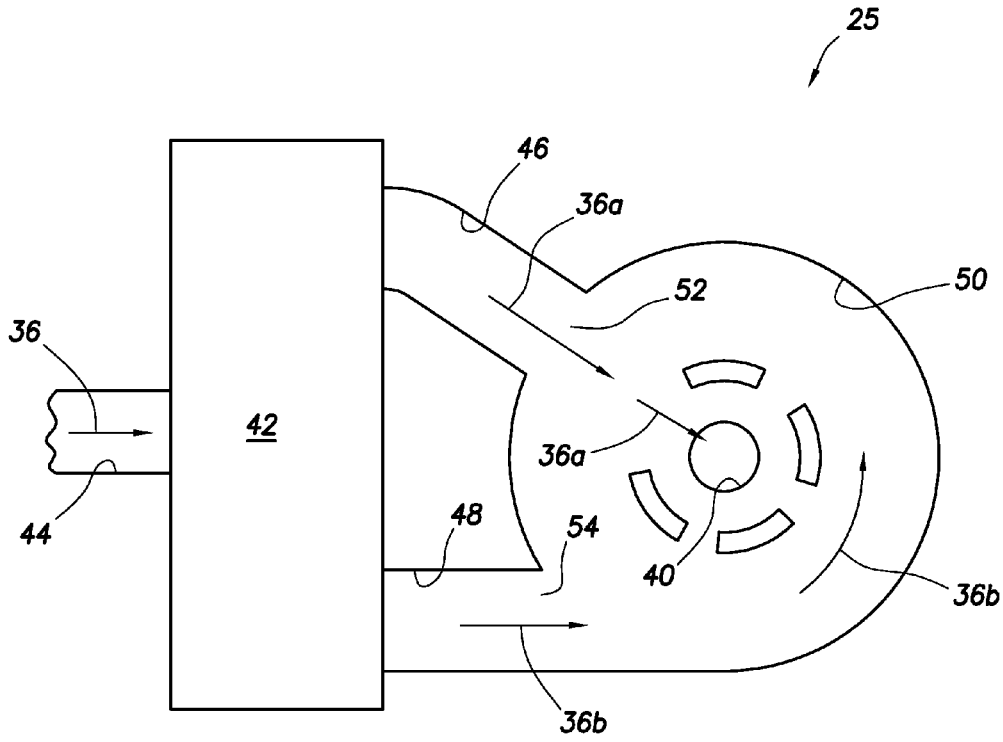
FIG. 3 is a representative cross-sectional view of the fluid discrimination system, taken along line 3-3 of FIG. 2.

Referring additionally now to FIG. 3, a cross-sectional view of the fluid discrimination system 25, taken along line 3-3 of FIG. 2, is representatively illustrated. The fluid discrimination system 25 example depicted in FIG. 3 may be used in the well system 10 of FIGS. 1 & 2, or it may be used in other well systems in keeping with the principles of this disclosure.

In FIG. 3, it may be seen that the fluid composition 36 flows from the inlet 38 to the outlet 40 via inlet flow path 44, a fluid discriminator 42, outlet flow paths 46, 48 and a flow chamber 50. The outlet flow paths 46, 48 intersect the chamber 50 at inlets 52, 54.

The outlet flow path 46 intersects the chamber 50 in a generally radial direction relative to the chamber and outlet 40. The outlet flow path 48, however, intersects the chamber 50 generally tangentially. Thus, flow entering the chamber 50 from the inlet 52 is in a generally radial direction, and flow entering the chamber from the inlet 54 is in a generally tangential direction. The tangential flow from the inlet 54 is guided to rotational flow by an outer wall of the chamber 50.

It will be appreciated that the indirect rotational flow from the inlet 54 to the outlet 40 dissipates more energy as compared to the relatively direct radial flow from the inlet 52 to the outlet 40. Therefore, rotational (including, e.g., spiral, helical, etc.) flow is resisted more by the system 25 than is radial flow of the fluid composition 36 through the chamber 50.

The fluid discriminator 42, in this example, discriminates between various fluid types in the fluid composition 36, or between ratios of desired to undesired fluids in the fluid composition, so that a fluid composition 36*a* having one fluid type, level of fluid type, ratio of desired to undesired fluid, etc., is directed to flow through the outlet flow path 46 to the chamber inlet 52, and another fluid composition 36*b* having a different fluid type, different level of fluid type, different ratio of desired to undesired fluid, etc., is directed to flow through the other outlet flow path 48 to the chamber inlet 54. Thus, the resistance to flow of the fluid composition 36 through the system 25 can be varied based on the fluid type(s) or the ratio of desired to undesired fluid in the fluid composition.

For example, the fluid discriminator 42 can cause more of the fluid composition 36 to flow through the outlet flow path 46 (thereby decreasing resistance to such flow) when the ratio of desired to undesired fluid increases, or when a certain desired fluid type or proportion of fluid type is present in the fluid composition, and the fluid discriminator can cause more of the fluid composition to flow through the outlet flow path 48 (thereby increasing resistance to such flow) when the ratio of desired to undesired fluid decreases, or when a certain desired fluid type or proportion of fluid type is not present in the fluid composition.

Figure 4:
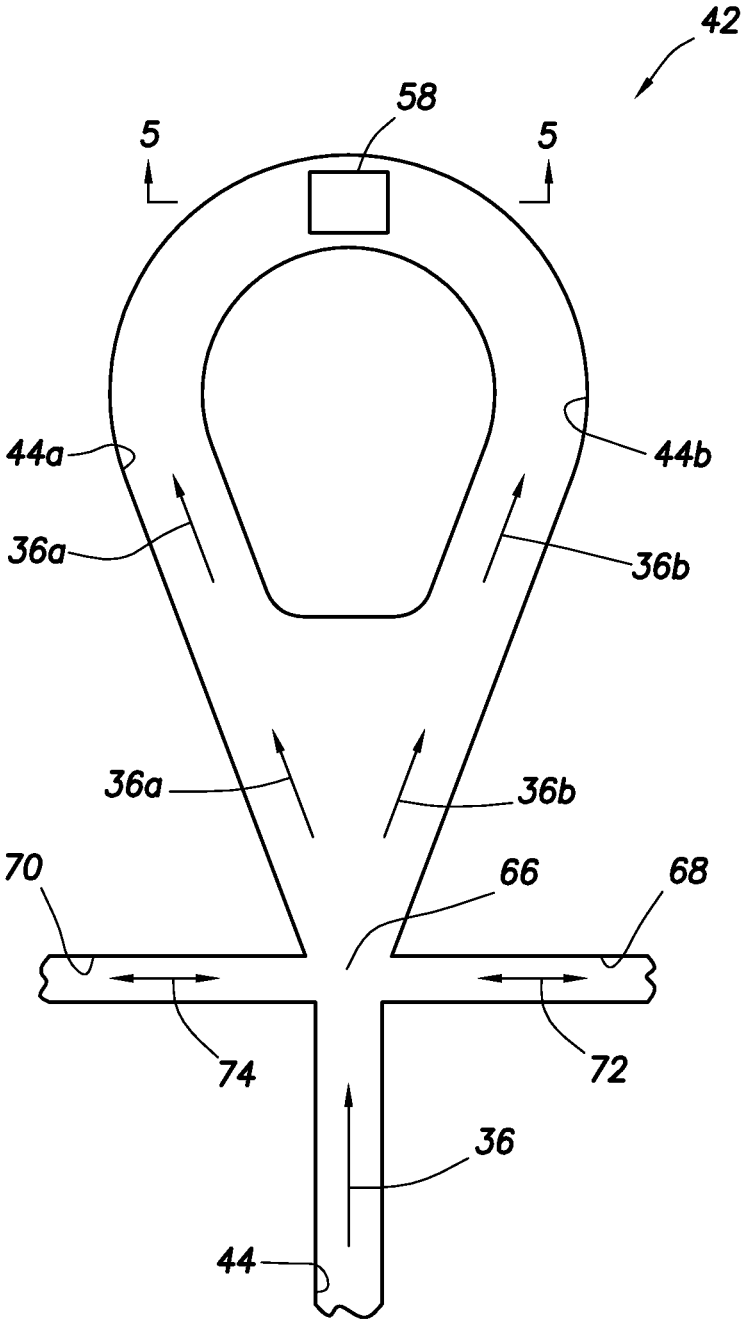
FIG. 4 is a representative cross-sectional view of a fluid discriminator which can embody the principles of this disclosure.
Figure 5:
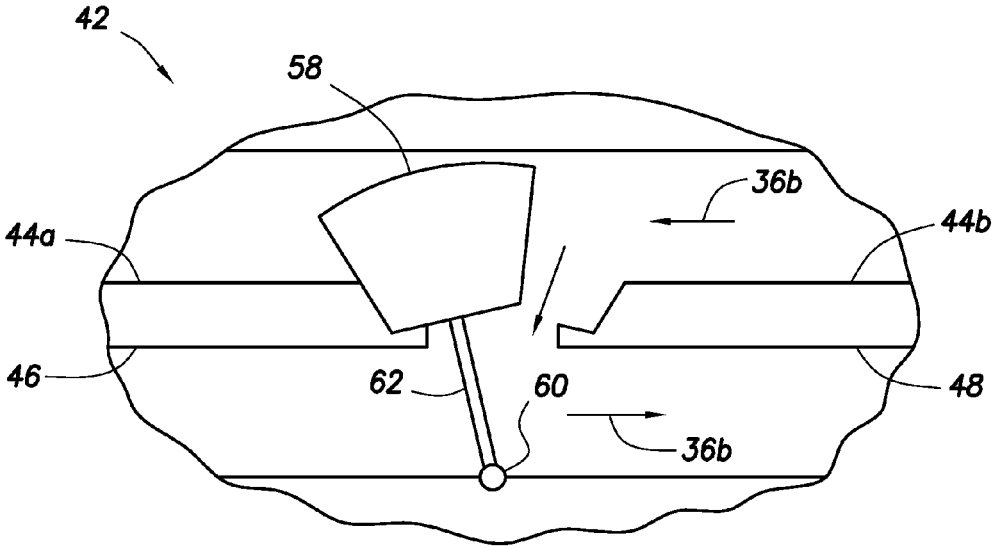
FIGS. 5 & 6 are representative cross-sectional views of the fluid discriminator, taken along line 5-5 of FIG. 4, a fluid composition being directed to different outlet flow paths in FIGS. 5 & 6.
Figure 6:
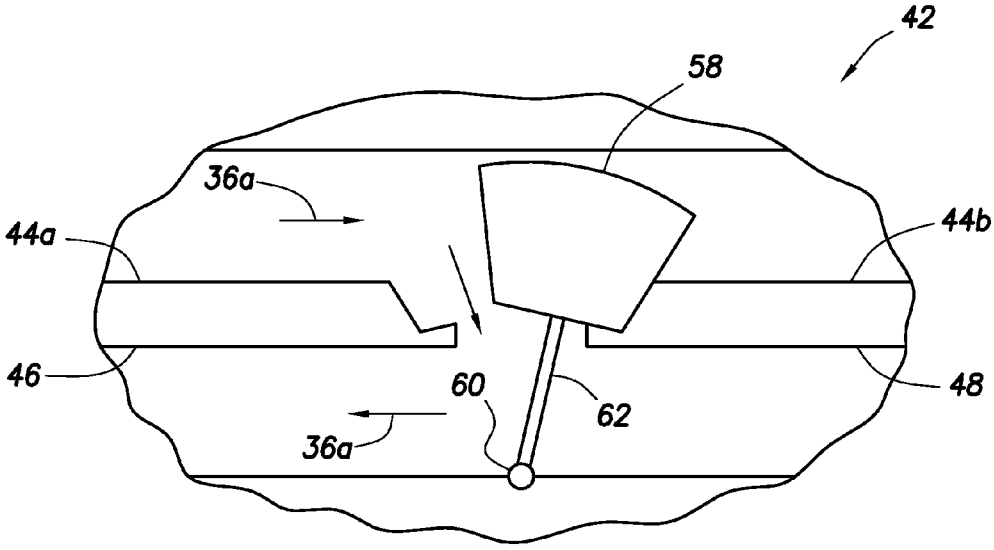

Referring additionally now to FIGS. 4-6, one example of the fluid discriminator 42 is representatively illustrated. The fluid discriminator 42 may be used in the fluid discrimination system 25 and well system 10 described above, or the fluid discriminator may be used with other systems in keeping with the scope of this disclosure.

The configuration of FIGS. 4-6 includes a structure 58 which displaces in response to a change in a proportion of the fluid composition 36 which flows through inlet flow paths 44*a,b* (that is, a ratio of the fluid composition which flows through one inlet flow path and the fluid composition which flows through the other inlet flow path).

For example, in FIG. 5, a majority of the fluid composition 36*b* flows via the flow path 44*b*, and this flow impinging on the structure 58 causes the structure to displace to a position in which such flow is directed to the outlet flow path 48. Note that, in FIG. 5, the structure 58 and a beam 62 extending between the structure and a connection 60 substantially block the fluid composition 36*b* from flowing to the outlet flow path 46.

In FIG. 6, a majority of the fluid composition 36*a* flows via the flow path 44*a* and, in response, the structure 58 displaces to a position in which such flow is directed to the outlet flow path 46. The structure 58 and the beam 62 substantially block the fluid composition 36*a* from flowing to the outlet flow path 48.

In other examples, the structure 58 or beam 62 may not block the flow of the fluid composition 36 (e.g., another member or structure may be used to block such flow), and the structure could be biased toward the FIG. 5 and/or FIG. 6 position (e.g., using springs, compressed gas, other biasing devices, etc.), thereby changing the proportion of the fluid composition 36 which must flow through a particular flow path 44*a,b* in order to displace the structure. Preferably, the fluid composition 36 does not have to exclusively flow through only one of the flow paths 44*a,b* in order to displace the structure 58 to a particular position, but such a design could be implemented, if desired.

The structure 58 is mounted via the connection 60. Preferably, the connection 60 serves to secure the structure 58, and also to resist a pressure differential applied across the structure from the flow paths 44*a,b* to the outlet flow paths 46, 48. When the fluid composition 36 is flowing through the system 25, this pressure differential can exist, and the connection 60 can resist the resulting forces applied to the structure 58, while still permitting the structure to displace freely in response to a change in the proportion of the flow via the flow paths 44*a,b*.

In the FIGS. 5 & 6 example, the connection 60 is depicted as a pivoting or rotational connection. However, in other examples, the connection 60 could be a rigid, sliding, translating, or other type of connection, thereby allowing for displacement of the structure 58 in any of circumferential, axial, longitudinal, lateral, radial, etc., directions.

In one example, the connection 60 could be a rigid connection, with a flexible beam 62 extending between the connection and the structure 58. The beam 62 could flex, instead of the connection 60 rotating, in order to allow the structure 58 to displace, and to provide a biasing force toward the position of FIG. 5, toward the position of FIG. 6, or toward any other position (e.g., a position between the FIGS. 5 & 6 positions, etc.).

The FIGS. 4-6 configuration utilizes a fluid switch 66 with multiple control passages 68, 70. The fluid switch 66 directs the fluid composition 36 flow toward the flow path 44*a* when flow 72 through the control passage 68 is toward the fluid switch, and/or when flow 74 in the control passage 70 is away from the fluid switch. The fluid switch 66 directs the fluid composition 36 flow toward the flow path 44*b* when flow 72 through the control passage 68 is away from the fluid switch, and/or when flow 74 in the control passage 70 is toward the fluid switch.

Thus, since the proportion of the fluid composition 36 which flows through the flow paths 44*a,b* can be changed by the fluid switch 66, in response to the flows 72, 74 through the control passages 68, 70, it follows that the resistance to flow of the fluid composition 36 through the system 25 can be changed by changing the flows through the control passages. For this purpose, the control passages 68, 70 may be connected to any of a variety of devices for influencing the flows 72, 74 through the control passages.

The flows 72, 74 through the control passages 68, 70 could be automatically changed in response to changes in one or more properties (such as density, viscosity, velocity, etc.) of the fluid composition 36, the flows could be controlled locally (e.g., in response to sensor measurements, etc.), or the flows could be controlled remotely (e.g., from the earth's surface, another remote location, etc.). Any technique for controlling the flows 72, 74 through the control passages 68, 70 may be used, in keeping with the scope of this disclosure.

Preferably, the flow 72 is toward the fluid switch 66, and/or the flow 74 is away from the fluid switch, when the fluid composition 36 has an increased ratio of desired to undesired fluids, or a certain proportion of a desired fluid type, so that more of the fluid composition will be directed by the fluid switch to flow toward the flow path 44*a*, thereby reducing the resistance to flow through the system 25. Conversely, the flow 72 is preferably away from the fluid switch 66, and/or the flow 74 is preferably toward the fluid switch, when the fluid composition 36 has a decreased ratio of desired to undesired fluids, or less than a threshold level of a desired fluid type, so that more of the fluid composition will be directed by the fluid switch to flow toward the flow path 44*b*, thereby increasing the resistance to flow through the system 25.

In other examples, the outlet flow paths 46, 48 could be connected to separate processing facilities for the different fluid types in the fluid composition 36, or the outlet flow paths could be connected to different production or injection equipment, etc. Thus, it should be understood that it is not necessary in keeping with the scope of this disclosure for the system 25 to variably resist flow of the fluid composition 36 from the fluid discriminator 42.

Figure 7:
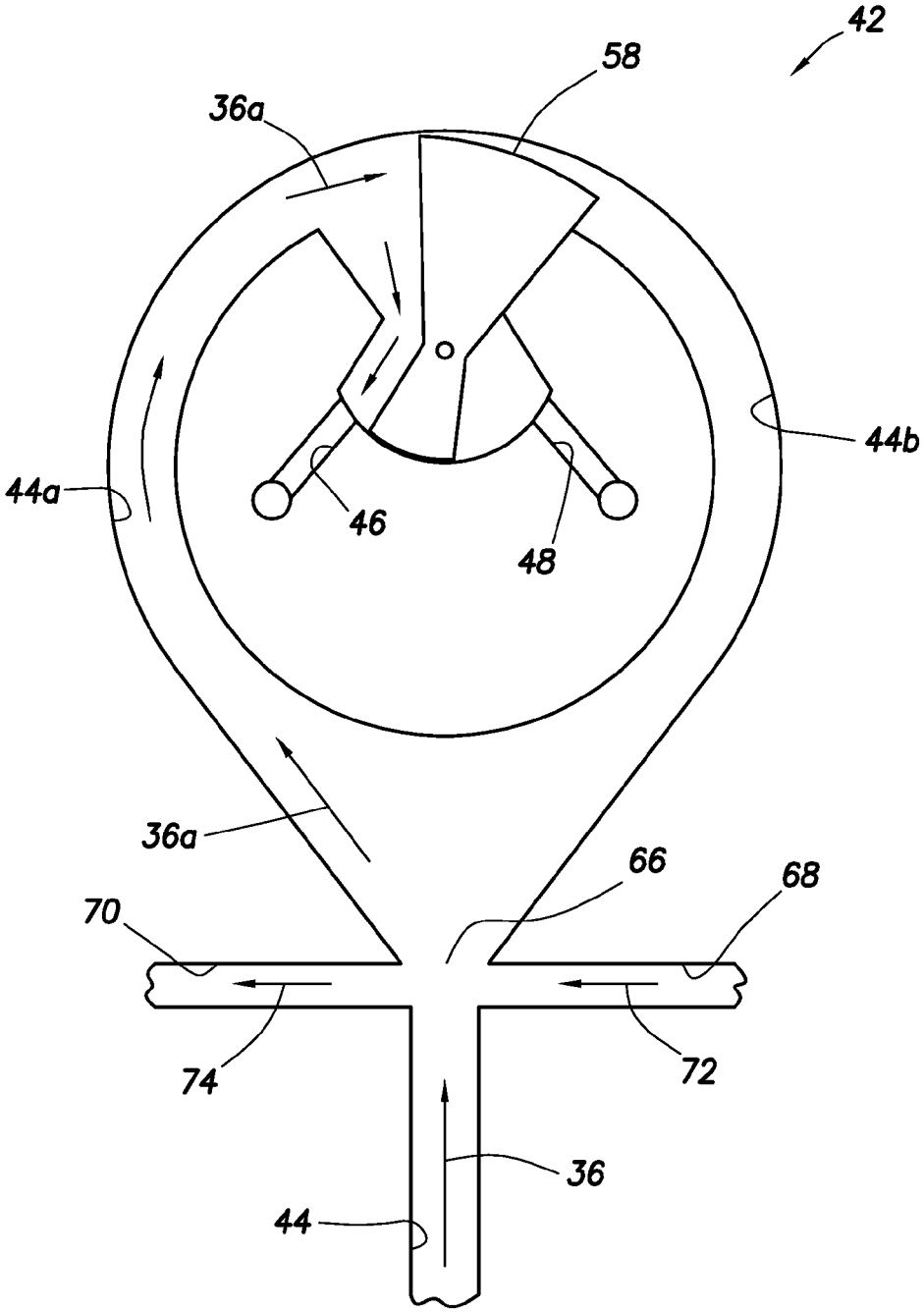
FIGS. 7 & 8 are representative cross-sectional views of another configuration of the fluid discriminator, a fluid composition being directed to different outlet flow paths in FIGS. 7 & 8.
Figure 8:
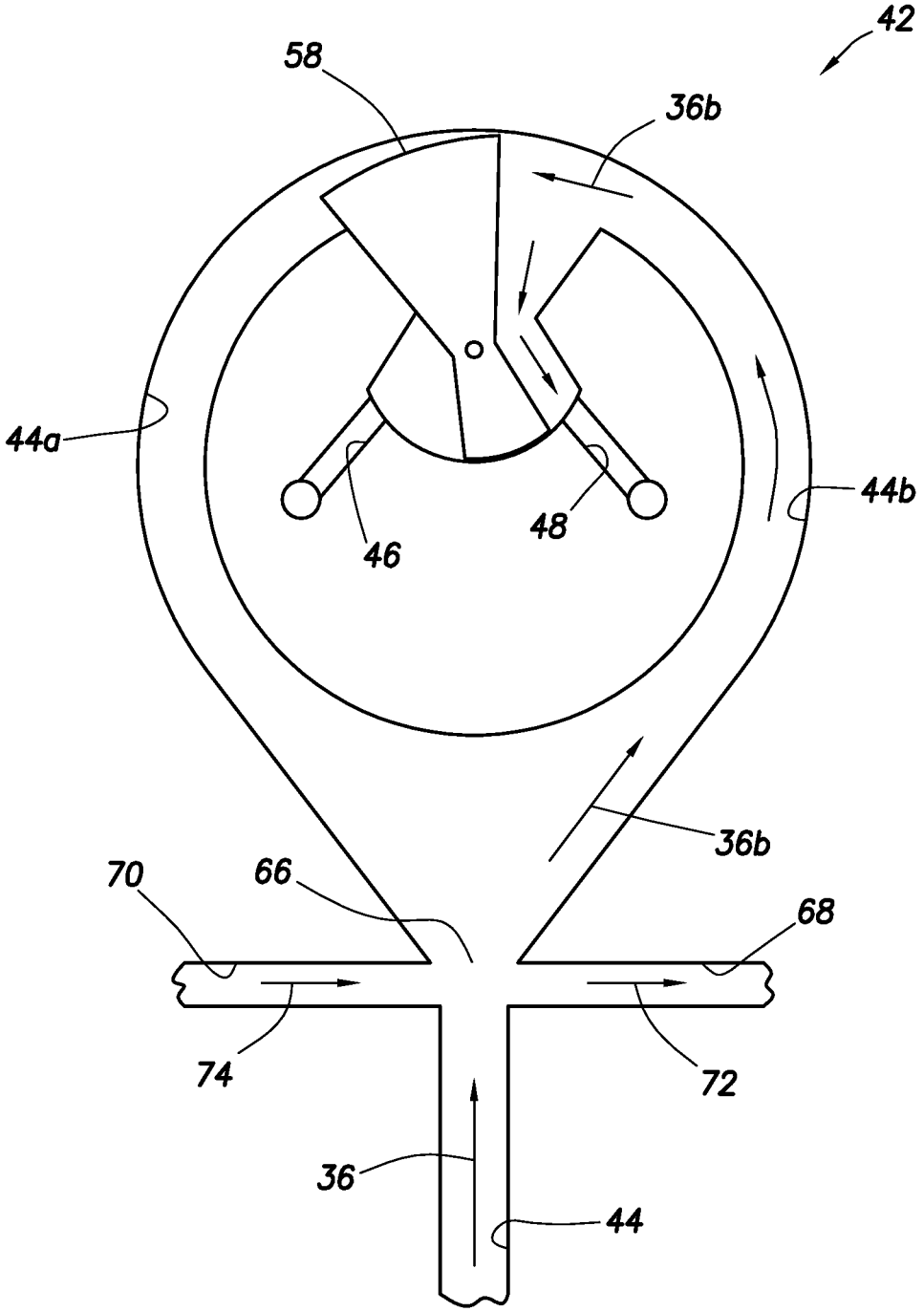

Referring additionally now to FIGS. 7 & 8, another configuration of the fluid discriminator 42 is representatively illustrated. In this configuration, the structure 58 rotates about the connection 60, in order to direct flow more toward the outlet flow path 46 (FIG. 7) or more toward the outlet flow path 48 (FIG. 8).

As in the configuration of FIGS. 4-6, the configuration of FIGS. 7 & 8 has the structure 58 exposed to flow in both of the flow paths 44*a,b*. Depending on a proportion of these flows, the structure 58 can displace to either of the FIGS. 7 & 8 positions (or to any position in-between those positions). The structure 58 in the FIGS. 4-8 configurations can be biased toward any position, or releasably retained at any position, in order to adjust the proportion of flows through the flow paths 44*a,b* needed to displace the structure to another position.

Figure 9:
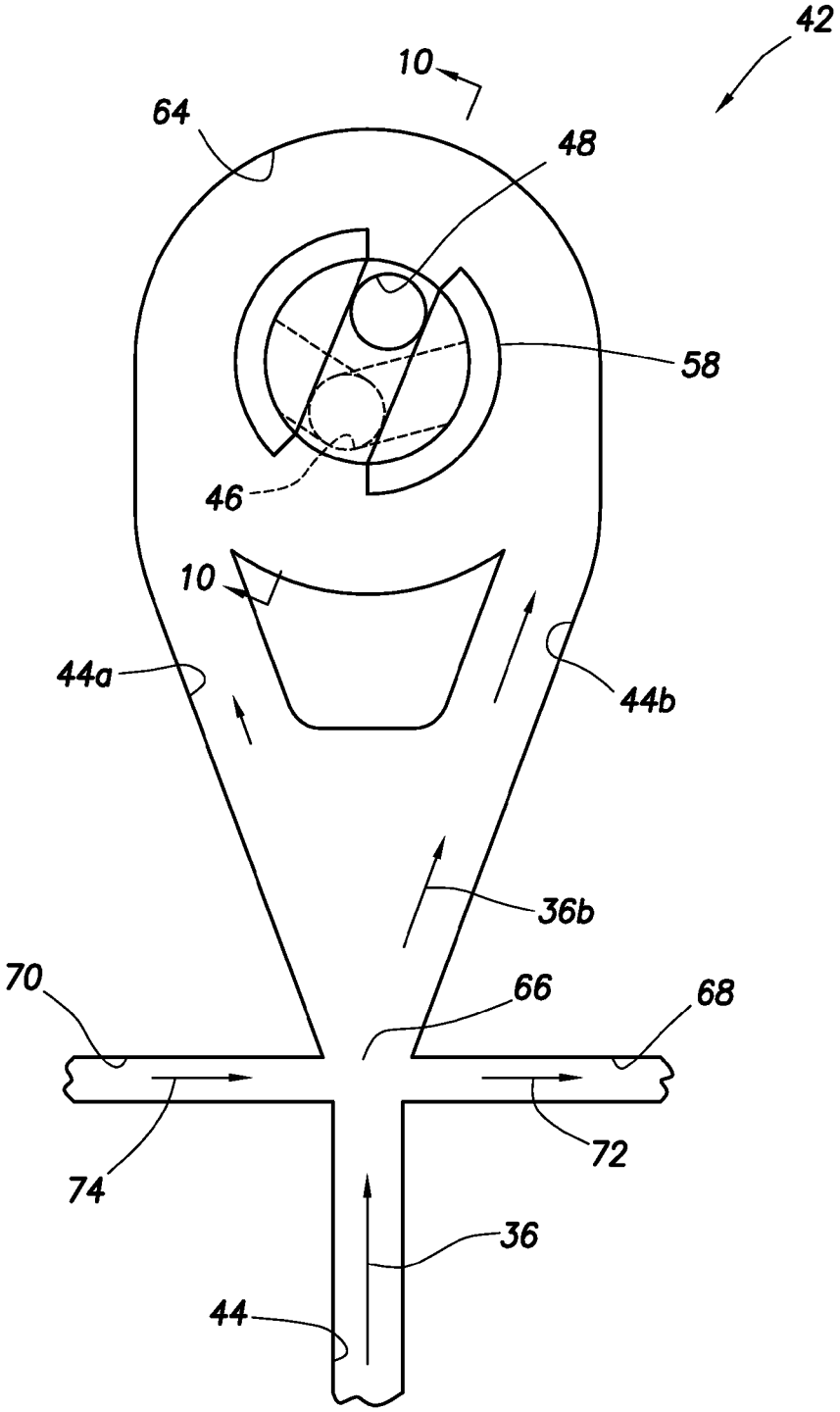
FIG. 9 is a representative cross-sectional view of another configuration of the fluid discriminator.
Figure 10:
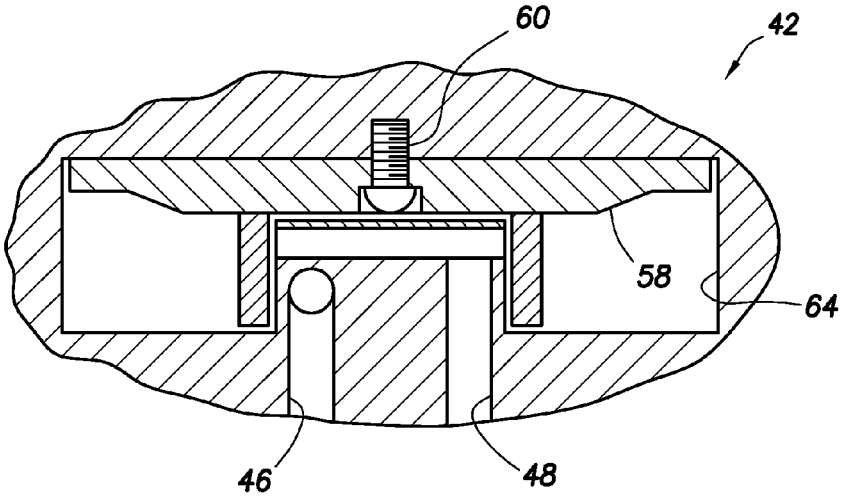
FIG. 10 is a representative cross-sectional view of the fluid discriminator, taken along line 10-10 of FIG. 9.

Referring additionally now to FIGS. 9 & 10, another configuration of the fluid discriminator 42 is representatively illustrated. In this configuration, the structure 58 is positioned in a chamber 64 connected to the flow paths 46, 48.

In the FIGS. 9 & 10 example, a majority of the flow of the fluid composition 36 through the flow path 44*a* results in the structure 58 rotating about the connection 60 to a position in which flow is directed to the outlet flow path 46. However, if a majority of the flow is through the flow path 44*b* to the chamber 64 (as depicted in FIG. 9), the structure 58 will rotate to a position in which the flow is directed to the outlet flow path 48.

The structure 58 in this example rotates about the connection 60 in response to rotational flow of the fluid composition 36 in the chamber 64. The direction of this rotational flow determines the direction of rotation of the structure 58, and thus determines whether more of the fluid composition 36 will exit the chamber 64 via the flow path 46 or the flow path 48.

Figure 12:
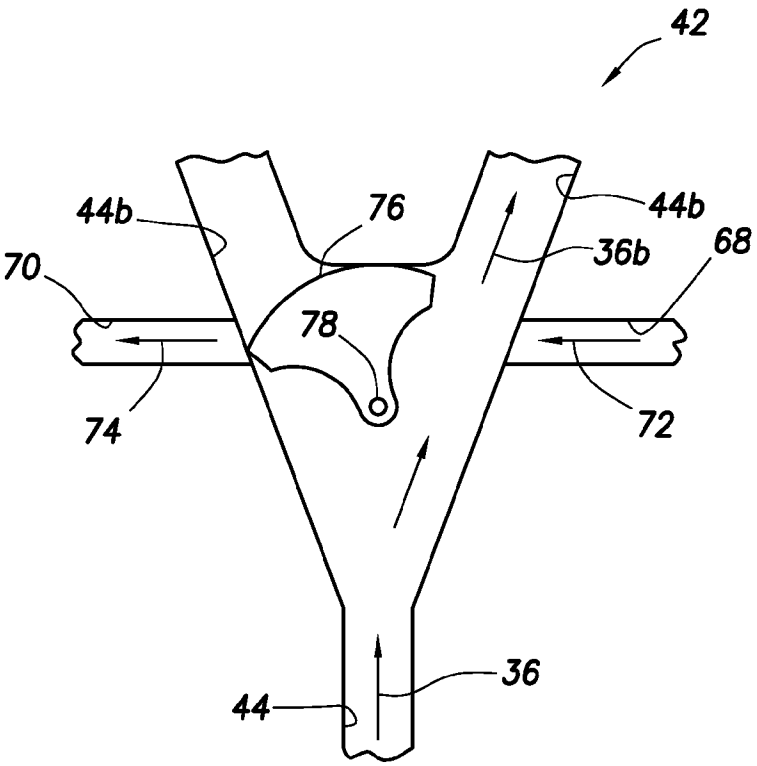
FIG. 12 is a representative cross-sectional view of another configuration of the fluid switch.
Figure 11:
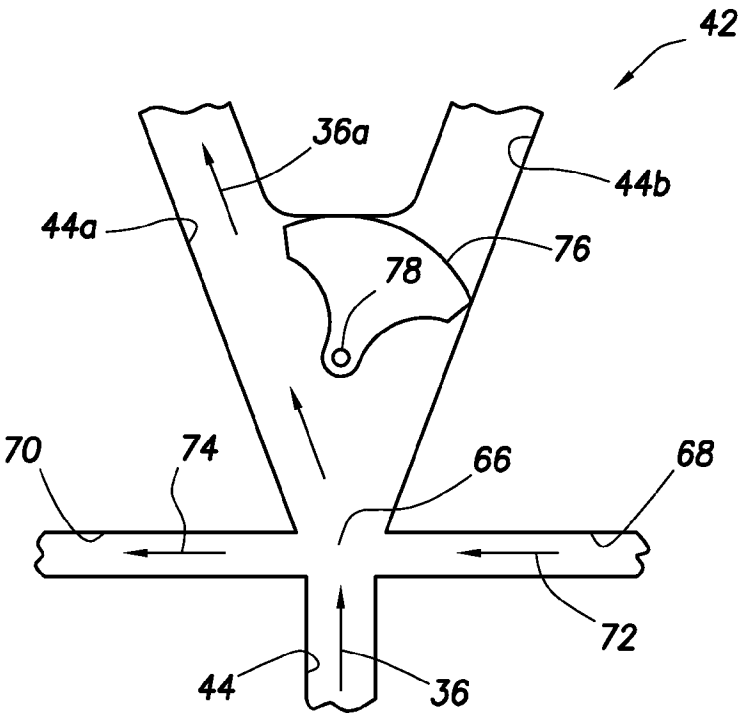
FIG. 11 is a representative cross-sectional view of a fluid switch which may be used in the fluid discriminator.

Referring additionally now to FIGS. 11 & 12, additional configurations of the fluid switch 66 are representatively illustrated. The fluid switch 66 in these configurations has a blocking device 76 which rotates about a connection 78 to increasingly block flow through one of the inlet flow paths 44*a,b* when the fluid switch directs the flow toward the other flow path. These fluid switch 66 configurations may be used in any fluid discriminator 42 configuration.

In the FIG. 11 example, either or both of the control passage flows 72, 74 influence the fluid composition 36 to flow toward the flow path 44*a*. Due to this flow toward the flow path 44*a* impinging on the blocking device 76, the blocking device rotates to a position in which the other flow path 44*b* is completely or partially blocked, thereby influencing an even greater proportion of the fluid composition to flow via the flow path 44*a*, and not via the flow path 44*b*. However, if either or both of the control passage flows 72, 74 influence the fluid composition 36 to flow toward the flow path 44*b*, this flow impinging on the blocking device 76 will rotate the blocking device to a position in which the other flow path 44*a* is completely or partially blocked, thereby influencing an even greater proportion of the fluid composition to flow via the flow path 44*b*, and not via the flow path 44*a*.

In the FIG. 12 example, either or both of the control passage flows 72, 74 influence the blocking device 76 to increasingly block one of the flow paths 44*a,b*. Thus, an increased proportion of the fluid composition 36 will flow through the flow path 44*a,b* which is less blocked by the device 76. When either or both of the flows 72, 74 influence the blocking device 76 to increasingly block the flow path 44*a*, the blocking device rotates to a position in which the other flow path 44*b* is not blocked, thereby influencing a greater proportion of the fluid composition to flow via the flow path 44*b*, and not via the flow path 44*a*. However, if either or both of the control passage flows 72, 74 influence the blocking device 76 to rotate toward the flow path 44*b*, the other flow path 44*a* will not be blocked, and a greater proportion of the fluid composition 36 will flow via the flow path 44*a*, and not via the flow path 44*b*.

By increasing the proportion of the fluid composition 36 which flows through the flow path 44*a* or 44*b*, operation of the fluid discriminator 42 is made more efficient. For example, resistance to flow through the system 25 can be readily increased when an unacceptably low ratio of desired to undesired fluids exists in the fluid composition 36, and resistance to flow through the system can be readily decreased when the fluid composition has a relatively high ratio of desired to undesired fluids.

In other examples, separation of fluid types can be made more efficient by increasing the proportion of the fluid composition 36 which flows through either the flow path 44*a* or the flow path 44*b*. The separated fluid types could be flowed to separate processing facilities, one fluid type could be produced, another fluid type could be injected into the formation 20 or another formation, etc.

Figure 13:
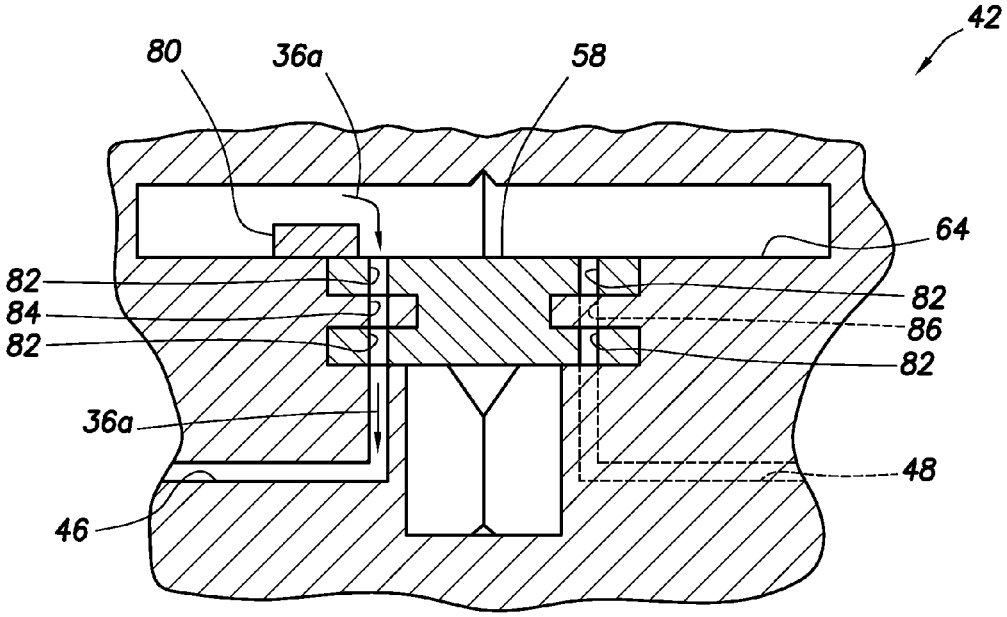
FIGS. 13 & 14 are representative cross-sectional views of another configuration of the fluid discriminator, FIG. 13 being taken along line 13-13 of FIG. 14.
Figure 14:
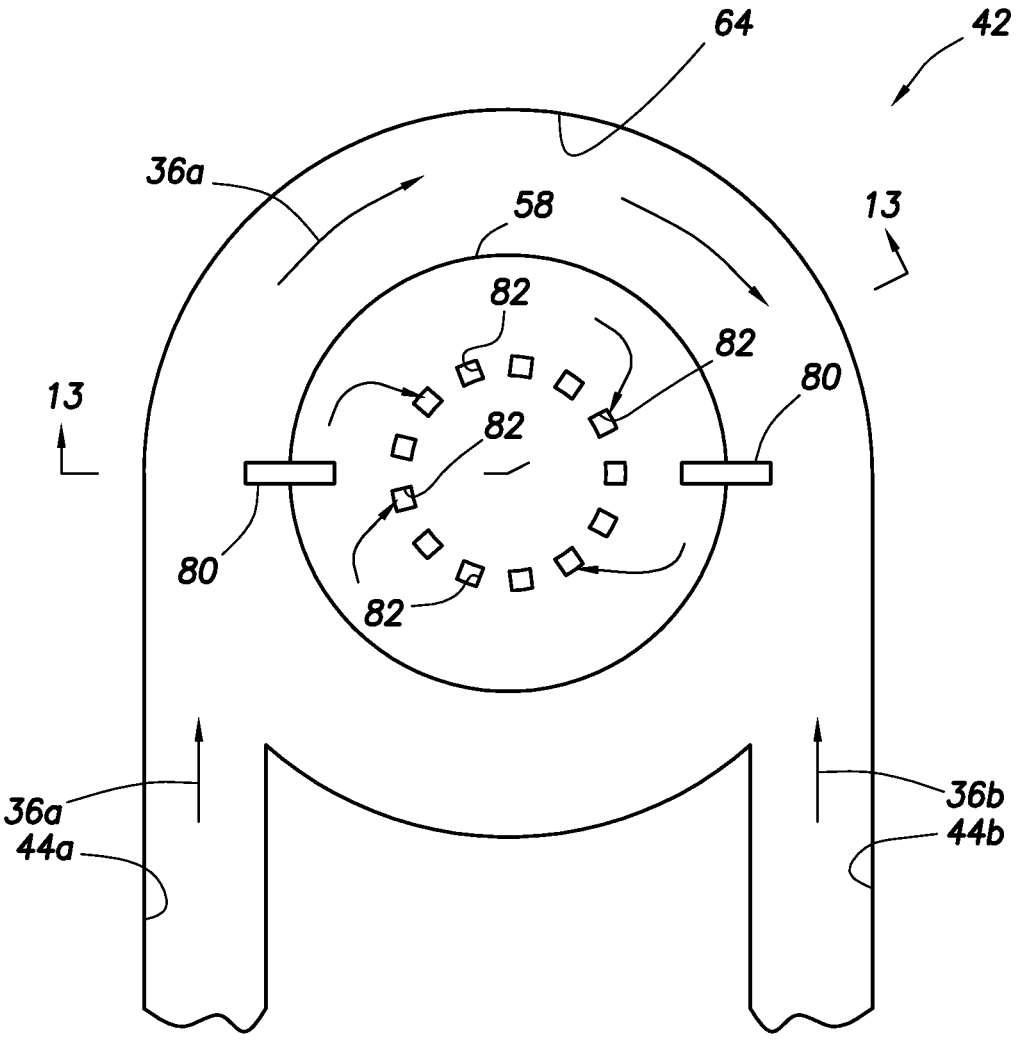

Referring additionally now to FIGS. 13 & 14, another configuration of the fluid discriminator 42 is representatively illustrated. This configuration is similar in some respects to the configuration of FIGS. 9 & 10, in that the structure 58 rotates in the chamber 64 in order to change the outlet flow path 46, 48. The direction of rotation of the structure 58 depends on through which of the flow paths 44*a* or 44*b* a greater proportion of the fluid composition 36 flows.

In the FIGS. 13 & 14 example, the structure 58 includes vanes 80 on which the fluid composition 36 impinges. Thus, rotational flow in the chamber 64 impinges on the vanes 80 and biases the structure 58 to rotate in the chamber.

When the structure 58 is in the position depicted in FIGS. 13 & 14, openings 82 align with openings 84, the structure substantially blocks flow from the chamber 64 to the outlet flow path 48, and the structure does not substantially block flow from the chamber 64 to the outlet flow path 46. However, if the structure 58 rotates to a position in which the openings 82, 86 are aligned, then the structure will not substantially block flow from the chamber 64 to the outlet flow path 48, and the structure will substantially block flow from the chamber 64 to the outlet flow path 46.

Figure 16:
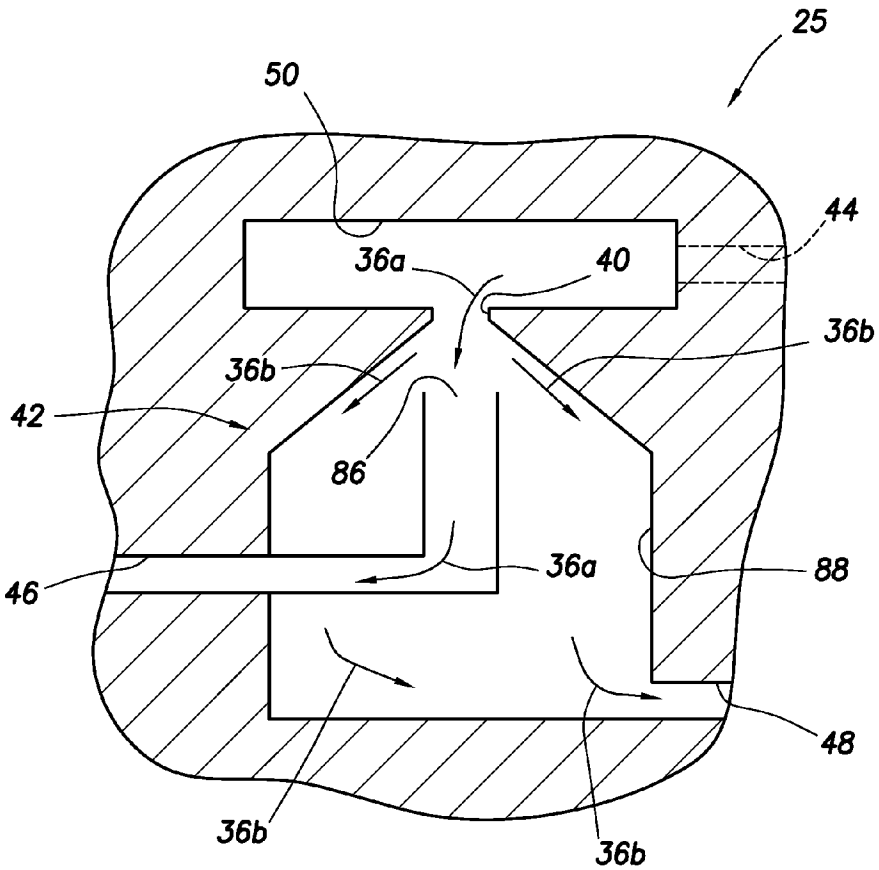
FIGS. 15 & 16 are representative cross-sectional views of another configuration of the fluid discriminator, FIG. 16 being taken along line 16-16 of FIG. 15.
Figure 15:
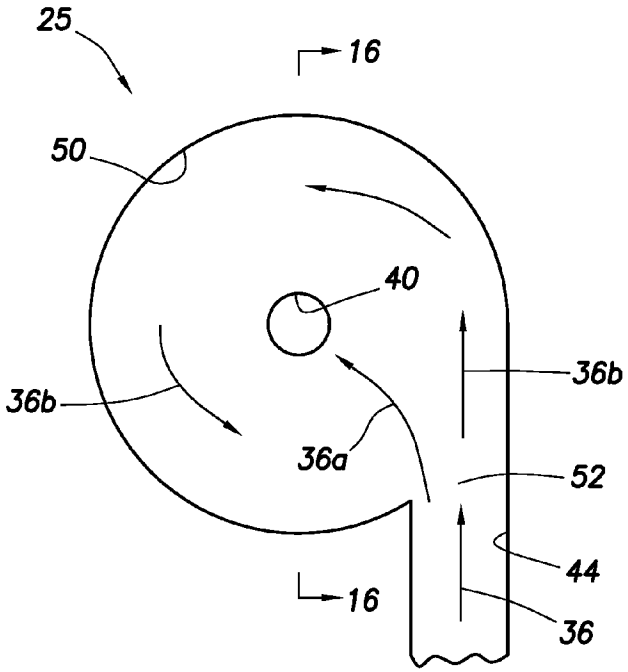

Referring additionally now to FIGS. 15 & 16, another configuration of the fluid discrimination system 25 is representatively illustrated. In this configuration, the fluid discriminator 42 is downstream of the chamber 50, thus, the fluid discriminator receives the fluid composition 36 which flows through the outlet 40. The fluid composition 36 flows more toward the outlet flow path 46 or 48, depending on whether the fluid composition flows directly or rotationally through the outlet 40.

In this example, the chamber 50 has only the inlet 52 through which the fluid composition 36 flows into the chamber. However, in other examples, multiple inlets (such as the multiple inlets 52, 54 of FIG. 3) could be used.

As depicted in FIG. 15, the fluid composition 36*a* (e.g., which can have a relatively low velocity, a relatively low density, a relatively high viscosity, a relatively high ratio of desired to undesired fluid, and/or a certain proportion of a desired fluid type, etc.) can flow directly radially toward the outlet 40 from the inlet 52, and so such flow has only minimal or no rotational direction to it. However, the fluid composition 36*b* (e.g., which can have a relatively high velocity, a relatively high density, a relatively low viscosity, a relatively low ratio of desired to undesired fluid, and/or less than a certain proportion of a desired fluid type, etc.) flows rotationally about the chamber 50 and the outlet 40 from the inlet 52.

As depicted in FIG. 16, the flow of the fluid composition 36*a* enters the outlet 40 from a radial direction, and flows directly into the outlet flow passage 46, an inlet 86 of which is positioned centrally with respect to the outlet 40 and within another chamber 88. The fluid composition 36*b*, however, flows rotationally through the outlet 40. The rotational momentum of the fluid composition 36*b* causes it to flow outward toward an outer wall of the chamber 88 as the fluid composition enters the chamber 88 via the outlet 40. The outlet flow path 48 receives the fluid composition 36*b* which flows along the walls of the chamber 88, but the outlet flow path 46 receives the fluid composition 36*a* which flows from the outlet 40 to the centrally located inlet 86.

Note that, although in certain examples described above, the two fluid compositions 36*a,b* may be depicted in a same drawing figure, this does not necessarily require that the fluid compositions 36*a,b* flow through the system 25 at the same time. Instead, the fluid composition 36 can at some times have the properties, characteristics, etc., of the fluid composition 36*a* (e.g., with a relatively low velocity, a relatively low density, a relatively high viscosity, a relatively high ratio of desired to undesired fluid, and/or a certain proportion of a desired fluid type, etc.), and the fluid composition 36 can at other times have the properties, characteristics, etc., of the fluid composition 36*b* (e.g., with a relatively high velocity, a relatively high density, a relatively low viscosity, a relatively low ratio of desired to undesired fluid, and/or less than a certain proportion of a desired fluid type, etc.). The fluid compositions 36*a,b* are depicted as merely two examples of the fluid composition 36, for illustration of how the fluid composition can flow differently through the system 25 based on different properties, characteristics, etc. of the fluid composition.

Although in certain examples described above, the structure 58 displaces by pivoting or rotating, it will be appreciated that the structure could be suitably designed to displace in any direction to thereby change the flow direction through the system 25. In various examples, the structure 58 could displace in circumferential, axial, longitudinal, lateral and/or radial directions.

Although in the examples described above only two outlet flow paths 46, 48 and two inlet flow paths 44*a,b* are used, it should be understood that the fluid discriminator 42 could be configured to utilize any number of outlet or inlet flow paths.

It may now be fully appreciated that this disclosure provides significant advancements to the art of discriminating between fluids in conjunction with well operations. In multiple examples described above, the fluid composition 36 can be directed to flow to different outlet flow paths 46, 48, depending on different properties, characteristics, etc. of fluids in the fluid composition.

In one example, a fluid discrimination system 25 for use with a subterranean well is described above. The system 25 can include a fluid discriminator 42 which selects through which of multiple outlet flow paths 46, 48 a fluid composition 36 flows, the selection being based on at least one direction of flow of the fluid composition 36 through the fluid discriminator 42, and the direction being dependent on at least one fluid type in the fluid composition 36.

The fluid discriminator 42 may select a first outlet flow path 46 in response an increase in a ratio of desired to undesired fluid in the fluid composition 36, and the fluid discriminator 42 may select a second outlet flow path 48 in response to a decrease in the ratio of desired to undesired fluid.

The fluid discriminator 42 may select a first outlet flow path 46 in response to the direction of flow being more radial, and the fluid discriminator 42 may select a second outlet flow path 48 in response to the direction of flow being more rotational.

The at least one direction can comprise opposite directions.

The at least one direction can comprise first and second directions. The fluid discriminator 42 can select a first outlet flow path 46 in response to flow of the fluid composition 36 more in the first direction, and the fluid discriminator 42 can select a second outlet flow path 48 in response to flow of the fluid composition 36 more in the second direction.

The flow of the fluid composition 36 in the first direction may impinge on a structure 58, whereby the structure 58 displaces and the first outlet flow path 46 is selected. The flow of the fluid composition 36 in the second direction may impinge on the structure 58, whereby the structure 58 displaces and the second outlet flow path 48 is selected. The structure 58 may rotate in response to the impingement of the fluid composition 36 on the structure 58.

A fluid switch 66 may select in which of the first and second directions the fluid composition 36 flows. The fluid switch 66 may direct the fluid composition 36 to flow more in the first direction in response to an increase in a ratio of desired to undesired fluid, and the fluid switch 66 may direct the fluid composition 36 to flow more in the second direction in response to a decrease in the ratio of desired to undesired fluid.

The first direction may be a radial direction. The second direction may be rotational.

Also described above is a fluid discriminator for use with a subterranean well. In one example, the fluid discriminator 42 can include a structure 58 which displaces in response to a flow of a fluid composition 36, whereby an outlet flow path 46, 48 of a majority of the fluid composition 36 changes in response to a change in a ratio of fluids in the fluid composition 36.

The structure 58 can be exposed to the flow of the fluid composition 36 in at least first and second directions. The outlet flow path 46, 48 can change in response to a change in a proportion of the fluid composition 36 which flows in the first and second directions.

The structure 58 may be more biased in a first direction by the flow of the fluid composition 36 more in the first direction, and the structure 58 may be more biased in a second direction by the flow of the fluid composition 36 more in the second direction.

The first direction may be opposite to the second direction. The first and second directions can comprise at least one of circumferential, axial, longitudinal, lateral, and/or radial directions.

The fluid discriminator 42 can also include a fluid switch 66 which directs the flow of the fluid composition 36 to at least first and second inlet flow paths 44*a,b*.

The structure 58 may be more biased in a first direction by the flow of the fluid composition 36 more through the first inlet flow path 44*a*, and the structure 58 may be more biased in a second direction by the flow of the fluid composition 36 more through the second inlet flow path 44*b*.

The structure 58 may pivot or rotate, and thereby change the outlet flow path 46, 48, in response to a change in a proportion of the fluid composition 36 which flows through the first and second inlet flow paths 44*a,b*. The structure 58 may rotate, and thereby change the outlet flow path 46, 48, in response to a change in a ratio of desired to undesired fluids.

The fluid switch 66 may comprise a blocking device 76 which at least partially blocks the flow of the fluid composition 36 through at least one of the first and second inlet flow paths 44*a,b*. The blocking device 76 can increasingly block one of the first and second inlet flow paths 44*a,b*, in response to the flow of the fluid composition 36 toward the other of the first and second inlet flow paths 44*a,b*. The fluid switch 66 may direct the flow of the fluid composition 36 toward one of the first and second inlet flow paths 44*a,b* in response to the blocking device 76 increasingly blocking the other of the first and second inlet flow paths 44*a,b*.

A method of discriminating between fluids flowed in a subterranean well is also described above. In one example, the method can include providing a fluid discriminator 42 which selects through which of multiple outlet flow paths 46, 48 a fluid composition 36 flows in the well, the selection being based on at least one direction of flow of the fluid composition 36 through the fluid discriminator 42, and the direction being dependent on a ratio of the fluids in the fluid composition 36.

The fluid discriminator 42 may select a first outlet flow path 46 in response an increase in the ratio of fluids, and the fluid discriminator 42 may select a second outlet flow path 48 in response to a decrease in the ratio of fluids.

The fluid discriminator 42 may select a first outlet flow path 46 in response to the direction of flow being more radial, and the fluid discriminator 42 may select a second outlet flow path 48 in response to the direction of flow being more rotational.

The at least one direction can comprise first and second directions. The fluid discriminator 42 can select a first outlet flow path 46 in response to flow of the fluid composition 36 more in the first direction, and the fluid discriminator 42 can select a second outlet flow path 48 in response to flow of the fluid composition 36 more in the second direction.

The flow of the fluid composition 36 in the first direction may impinge on a structure 58, whereby the structure 58 displaces and the first outlet flow path 46 is selected. The flow of the fluid composition 36 in the second direction may impinge on the structure 58, whereby the structure 58 displaces and the second outlet flow path 48 is selected. The structure 58 can rotate in response to the impingement of the fluid composition 36 on the structure 58.

A fluid switch 66 may select in which of the first and second directions the fluid composition 36 flows. The fluid switch 66 may direct the fluid composition 36 to flow more in the first direction in response to an increase in the ratio of fluids, and the fluid switch 66 may direct the fluid composition 36 to flow more in the second direction in response to a decrease in the ratio of fluids.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include additional features or elements (the same as or different from the named feature or element). Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A fluid discrimination system for use with a subterranean well, the system comprising:

a fluid discriminator through which a fluid composition flows in the subterranean well; and the fluid discriminator selects through which of multiple outlet flow paths the fluid composition flows, the selection being based on at least one direction of flow of the fluid composition through the fluid discriminator, and the direction being dependent on a ratio of desired to undesired fluid in the fluid composition, wherein the at least one direction comprises first and second directions, wherein the fluid discriminator selects a first outlet flow path in response to flow of the fluid composition more in the first direction, wherein the fluid discriminator selects a second outlet flow path in response to flow of the fluid composition more in the second direction, and wherein rotational flow of the fluid composition in the first direction impinges on a structure, whereby the structure displaces and the first outlet flow path is selected.

2. The system of claim 1, wherein rotational flow of the fluid composition in the second direction impinges on the structure, whereby the structure displaces and the second outlet flow path is selected.

3. The system of claim 1, wherein the structure rotates in response to the impingement of the fluid composition on the structure.

4. A fluid discriminator for use with a subterranean well, the fluid discriminator comprising:

a structure which displaces in response to a rotational flow of a fluid composition in the subterranean well, whereby an outlet flow path of a majority of the fluid composition changes in response to a change in a ratio of fluids in the fluid composition; and a fluid switch which directs the flow of the fluid composition to at least first and second inlet flow paths, wherein the rotational flow of the fluid composition impinges the structure, wherein the structure is displaced in response to the impingement, and wherein the outlet flow path changes in response to displacement of the structure.

5. The fluid discriminator of claim 4, wherein the structure is exposed to the flow of the fluid composition in at least first and second directions, and wherein the outlet flow path changes in response to a change in a proportion of the fluid composition which flows in the first and second directions.

6. The fluid discriminator of claim 4, wherein the structure is more biased in a first direction by the flow of the fluid composition more in the first direction, and wherein the structure is more biased in a second direction by the flow of the fluid composition more in the second direction.

7. The fluid discriminator of claim 6, wherein the first direction is opposite to the second direction.

8. The fluid discriminator of claim 6, wherein the first and second directions comprise at least one of the group including circumferential, axial, longitudinal, lateral, and radial directions.

9. The fluid discriminator of claim 4, wherein the structure is more biased in a first direction by the flow of the fluid composition more through the first inlet flow path, and wherein the structure is more biased in a second direction by the flow of the fluid composition more through the second inlet flow path.

10. The fluid discriminator of claim 4, wherein the structure pivots, and thereby changes the outlet flow path, in response to a change in a proportion of the fluid composition which flows through the first and second inlet flow paths.

11. The fluid discriminator of claim 4, wherein the structure rotates, and thereby changes the outlet flow path, in response to a change in a proportion of the fluid composition which flows through the first and second inlet flow paths.

12. The fluid discriminator of claim 4, wherein the structure rotates, and thereby changes the outlet flow path, in response to a change in a ratio of desired to undesired fluids.

13. The fluid discriminator of claim 4, wherein the fluid switch comprises a blocking device which at least partially blocks the flow of the fluid composition through at least one of the first and second inlet flow paths.

14. The fluid discriminator of claim 13, wherein the blocking device increasingly blocks one of the first and second inlet flow paths, in response to the flow of the fluid composition toward the other of the first and second inlet flow paths.

15. The fluid discriminator of claim 13, wherein the fluid switch directs the flow of the fluid composition toward one of the first and second inlet flow paths in response to the blocking device increasingly blocking the other of the first and second inlet flow paths.

16. A method of discriminating between fluids flowed in a subterranean well, the method comprising:

providing a fluid discriminator which selects through which of multiple outlet flow paths a fluid composition flows in the well, the selection being based on at least one direction of flow of the fluid composition through the fluid discriminator, and the direction being dependent on a ratio of the fluids in the fluid composition, wherein the at least one direction comprises first and second directions, wherein the fluid discriminator selects a first outlet flow path in response to flow of the fluid composition more in the first direction, wherein the fluid discriminator selects a second outlet flow path in response to flow of the fluid composition more in the second direction, and wherein rotational flow of the fluid composition in the first direction impinges on a structure, whereby the structure displaces and the first outlet flow path is selected.

17. The method of claim 16, wherein rotational flow of the fluid composition in the second direction impinges on the structure, whereby the structure displaces and the second outlet flow path is selected.

18. The method of claim 16, wherein the structure rotates in response to the impingement of the fluid composition on the structure.

* * * * *

UNITED STATES PATENT AND TRADEMARK OFFICE

CERTIFICATE OF CORRECTION

PATENT NO. : 8,739,880 B2
APPLICATION NO. : 13/659375
DATED : June 3, 2014
INVENTOR(S) : Jason D. Dykstra and Michael L. Fripp It is certified that error appears in the above-identified patent and that said Letters Patent is hereby corrected as shown below:

Title page, insert item 30, -- Foreign Application Priority Data -- section,
insert -- 7 November 2011 (WO) ..... PCT/US11/59534 --.

Signed and Sealed this
Ninth Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,739,880 B2
APPLICATION NO. : 13/659375
DATED : June 3, 2014
INVENTOR(S) : Jason D. Dykstra and Michael L. Fripp It is certified that error appears in the above-identified patent and that said Letters Patent is hereby corrected as shown below:

Title page, Item 73, Assignee:, delete "P.C." and insert in place thereof -- Inc. --.

Signed and Sealed this
Twentieth Day of January, 2015

Michelle K. Lee

Michelle K. Lee
*Deputy Director of the United States Patent and Trademark Office*